United States Patent [19]

Hickman et al.

[11] 4,079,701

[45] Mar. 21, 1978

[54] STEAM GENERATOR SLUDGE REMOVAL SYSTEM

[75] Inventors: Robert A. Hickman, Monroeville; Ralph W. Tolino, Wilkinsburg Borough, both of Pa.

[73] Assignee: Westinghouse Electric Corporation, Pittsburgh, Pa.

[21] Appl. No.: 686,861

[22] Filed: May 17, 1976

[51] Int. Cl.[2] ..... F22B 37/52; F22B 37/54

[52] U.S. Cl. ..... 122/382; 122/405

[58] Field of Search ..... 122/379, 382, 383, 384, 122/405

[56] References Cited

U.S. PATENT DOCUMENTS

| | | | |
|---|---|---|---|
| 906,652 | 12/1908 | Nicholson et al. | 122/384 |
| 1,158,948 | 11/1915 | McLean | 122/405 |
| 1,696,005 | 12/1928 | Kothe | 122/405 |
| 3,915,122 | 10/1975 | Schroder | 122/32 |

*Primary Examiner*—Kenneth W. Sprague

*Attorney, Agent, or Firm*—L. A. DePaul; Z. L. Dermer

[57] ABSTRACT

A system for removing sludge that may be deposited on a tube sheet of a steam generator. Headers are arranged at the elevation of the sludge to be removed establishing a circumferential fluid stream at that elevation. A fluid lance is moved along the line between the headers emitting a fluid jet perpendicular to the line of movement of the fluid lance at an elevation substantially corresponding to the level of sludge deposits. The fluid jet forces the sludge to the periphery of the tube sheet where the sludge is entrained in and carried away by the circumferential fluid stream.

5 Claims, 4 Drawing Figures

STEAM GENERATOR SLUDGE REMOVAL SYSTEM

BACKGROUND OF THE INVENTION

This invention relates to steam generators and more particularly to systems for removing sludge deposits from the tube sheets of steam generators.

A typical nuclear steam generator comprises a vertically oriented shell, a plurality of U-shaped tubes disposed in the shell so as to form a tube bundle, a tube sheet for supporting the tubes at the ends opposite the U-like curvature, a dividing plate that cooperates with the tube sheet forming a primary fluid inlet header at one end of the tube bundle and a primary fluid outlet header at the other end of the tube bundle, a primary fluid inlet nozzle in fluid communication with the primary fluid inlet header and a primary fluid outlet nozzle in fluid communication with the primary fluid outlet header. The steam generator also comprises a wrapper disposed between the tube bundle and the shell to form an annular chamber adjacemt the shell, and a feedwater ring disposed above the U-line curvature end of the tube bundle. The primary fluid having been heated by circulation through the reactor core enters the steam generator through the primary fluid inlet nozzle. From the primary fluid inlet nozzle, the primary fluid is conducted through the primary fluid inlet header, through the U-tube bundle, out the primary fluid outlet header, through the primary fluid outlet nozzle to the remainder of the reactor coolant system. At the same time, feedwater is introduced to the steam generator through the feedwater ring. The feedwater is conducted down the annular chamber adjacent the shell until the tube sheet near the bottom of the annular chamber causes the feedwater to reverse direction passing in heat transfer relationship with the outside of the U-tubes and up through the inside of the wrapper. While the feedwater is circulating in heat transfer relationship with the tube bundle, heat is transferred from the primary fluid in the tubes to the feedwater surrounding the tubes causing a portion of the feedwater to be converted to steam. The steam then rises and is circulated through typical electrical generating equipment generating electricity in a manner well known in the art.

Since the primary fluid contains radioactive particles and is isolated from the feedwater only by the U-tube walls which may be constructed from Inconel, the U-tube walls form part of the primary boundary for isolating these radioactive particles. It is, therefore, important that the U-tubes be maintained defect-free so that no breaks will occur in the U-tubes. However, experience has shown that under certain conditions the U-tubes may develop leaks therein which allow radioactive particles to contaminate the feedwater, a highly undesirable result.

There is now thought to be at least two causes of tube leaks in steam generators. One cause of these leaks is considered to be related to the chemical environment on the feedwater side of the tubes. Analysis of tube samples taken from operating steam generators which have experienced leaks has shown that the leaks were caused by cracks in the tubes resulting from intergranular corrosion. High caustic levels found in the vicinity of the cracks in the tube specimens taken from operating steam generators, and the similarity of these cracks to failures produced by caustic under controlled laboratory conditions have identified high caustic levels as the cause of the intergranular corrosion and thus the cause of the tube cracking.

The other cause of tube leaks is thought to be tube thinning. Eddy current tests of the tubes have indicated that the thinning occurs on the tubes near the tube sheet at levels corresponding to the levels of sludge that has accumulated on the tube sheet. The sludge is mainly iron oxides and copper compounds along with traces of other metals that have settled out of the feedwater onto the tube sheet. The level of sludge accumulation may be inferred by eddy current testing with a low frequency signal that is sensitive to the magnetite in the sludge. The correlation between sludge levels and tube wall thinning locations strongly suggests that the sludge deposits provide a site for concentration of the phosphate solution or other corrosive agents at the tube wall that results in tube thinning.

One known method for removal of this sludge is referred to as the sludge lance-suction method. Sludge lancing consists of using high pressure water to break up and slurry the sludge in conjunction with suction and filtration equipment that remove the water-sludge mixture for disposal or recirculation. In the sludge lancing method a six inch handhole is used to provide access so that two flexible perforated suction headers may be placed on and along the periphery of the tube sheet around the tube bundles. A high velocity water lance is then introduced through the handhole and aligned between the tube rows. The lance is then moved along the tube sheet while two high velocity water jets are established perpendicular to the movement of the lance. The water jets force the sludge toward the periphery of the tube sheet where the water-sludge mixture should be sucked into the flexible suction headers. While theoretically the sludge lance-suction method should remove the sludge deposits, experience has shown that it is not too effective.

One of the problems with the sludge lance-suction method is that a wide slot of water, caused by reflection or expanded water volume, exits the tube bundle near the periphery of the tube sheet and overwhelms the suction headers' capacity. Consequently, the sludge is either redeposited in the wrapper area or washed back into the tube sheet. Also when the second side of the generator is being lanced a significant amount of wash-back will occur to the side which was lanced first. In addition, the suction header required such an abundance of holes in the flexible headers that it was not possible to maintain a sufficient suction near the end of the header. Furthermore, it is not mechanically feasible to properly align the holes in a flexible header where access is as limited as in the case of a nuclear steam generator.

SUMMARY OF THE INVENTION

A system for removing sludge that may be deposited around heat transfer tubes that extend through a cylindrical tube sheet of a steam generator. An injection header and a suction header are placed diametrically opposite each other near the elevation of the cylindrical tube sheet causing a circumferential fluid stream to be established from the injection header around the heat transfer tube bundle to the suction header. A fluid lance is moved along the line between the injection header and the suction header while emitting a fluid jet perpendicular to the line of movement of the fluid lance at an elevation substantially corresponding to or above the level of sludge deposits on the cylindrical tube sheet.

The fluid jet forces the sludge to the periphery of the cylindrical tube sheet where the sludge is entrained in and carried away by the circumferential fluid stream.

It is an object of this invention to provide a method for removing sludge that has accumulated in a steam generator.

It is a particular object of this invention to provide a method for removing sludge that has accumulated on a tube sheet of a steam generator by using a fluid lance in conjunction with a peripheral fluid stream.

It is a more particular object of this invention to provide a method for removing sludge that has accumulated on a tube sheet of a steam generator by using a water lance in conjunction with a peripheral water stream.

BRIEF DESCRIPTION OF THE DRAWINGS

While the specification concludes with claims specifically pointing out and distinctly claiming the subject matter of the invention, it is believed the invention will be better understood from the following description taken in conjunction with the accompanying drawings, wherein:

DESCRIPTION OF THE PREFERRED EMBODIMENT

In a U-tube type steam generator, a tube sheet supports a bundle of heat transfer U-tubes. During operation, a sludge may form on the tube sheet around the U-tubes causing failure of the tubes. Failure of the tubes results in a release of radioactive particles from the primary reactor coolant into the feedwater of the steam generator. The invention, herein described, is a method for removing this sludge accumulation before it causes tube failure.

Figure 1:
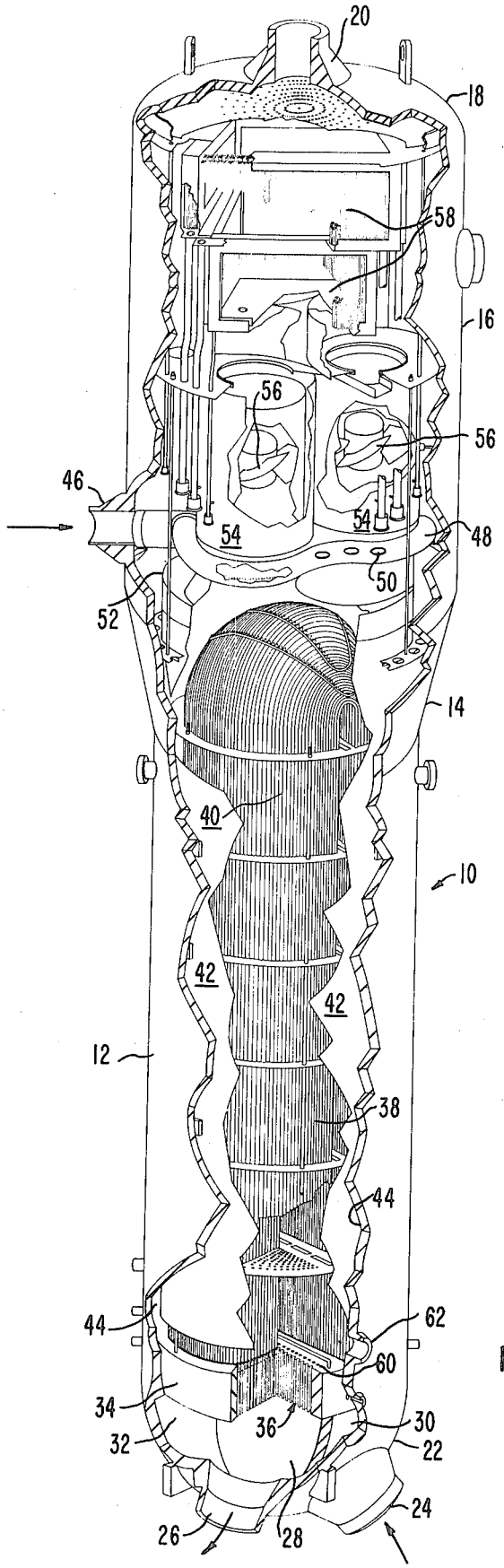
FIG. 1 is a partial cross-sectional view in elevation of a typical steam generator.

Referring to FIG. 1, a nuclear steam generator referred to generally as 10, comprises a lower shell 12 connected to a frustoconical transition shell 14 which connects lower shell 12 to an upper shell 16. A dished head 18 having a steam nozzle 20 disposed thereon encloses upper shell 16 while a substantially spherical head 22 having inlet nozzle 24 and an outlet nozzle 26 disposed thereon encloses lower shell 12. A dividing plate 28 centrally disposed in spherical head 22 divides spherical head 22 into an inlet comparitment 30 and an outlet compartment 32. The inlet compartment 30 is in fluid communication with inlet nozzle 24 while outlet compartment 32 is in fluid communication with outlet nozzle 26. A tube sheet 34 having tube holes 36 therein is attached to lower shell 12 and spherical head 22 so as to isolate the portion of steam generator 10 above tube sheet 34 from the portion below tube sheet 34 in a fluid tight manner. Tubes 38 which are heat transfer tubes shaped with a U-like curvature are disposed in tube holes 36. The tubes 38 which may number about 7,000 form a tube bundle 40. Dividing plate 28 is attached to tube sheet 34 so that inlet compartment 30 is physically divided from outlet compartment 32. Each tube 38 extends from tube sheet 34 where one end of each tube 38 is in fluid communication with inlet compartment 30, up into transition shell 14 where each tube 38 is formed in a U-like configuration, and back down to tube sheet 34 where the other end of each tube 38 is in fluid communication with outlet compartment 32. In operation, the reactor coolant having been heated from circulation through the reactor core enters steam generator 10 thorugh inlet nozzle 24 and flows into inlet compartment 30. From inlet compartment 30, the reactor coolant flows through tubes 38 in tube sheet 34, up through the U-shaped curvature of tubes 38, down through tubes 38 into outlet compartment 32. From outlet compartment 32, the reactor coolant is circulated through the remainder of the reactor coolant system in a manner well known in the art.

Again referring to FIG. 1, tube bundle 40 is encircled by a wrapper 42 which extends from near the tube sheet 34 into the region of transistion shell 14. Wrapper 42 together with lower shell 12 form an annular chamber 44. A secondary fluid or feedwater inlet nozzle 46 is disposed on upper shell 16 above tube bundle 40. A feedwater header 48 comprising three loops forming a generally cloverleaf-shaped ring is attached to feedwater inlet nozzle 46. Feedwater header 48 has therein a plurality of discharge ports 50 arranged in varying arrays so that a greater number of discharge ports 50 are directed toward annular chamber 44 than are directed otherwise.

During operation, feedwater enters steam generator 10 through feedwater inlet nozzle 46, flows through feedwater header 48, and out of feedwater header 48 through discharge ports 50. The greater portion of the feedwater exiting discharge ports 50, flow down annular chamber 44 until the feedwater contacts tube sheet 34. Once reaching the bottom of annular chamber 44 near tube sheet 34, the feedwater is directed inward around tubes 38 of tube bundle 40 where the feedwater passes in a heat transfer relationship with tubes 38. The hot reactor coolant being in tubes 38 transfers heat through tubes 38 to the feedwater thereby heating the feedwater. The heated feedwater then rises by natural circulation up through the tube bundle 40. In its travel around tube bundle 40, the feedwater continues to be heated until steam is produced in a manner well known in the art.

Now referring to the upper portion of FIG. 1, wrapper 42 has an upper cover or wrapper head 52 disposed thereon above tube bundle 40. Disposed on wrapper head 52 are sleeves 54 which are in fluid communication with the steam produced near tube bundle 40 and have centrifugal swirl vanes 56 disposed therein. Disposed above sleeves 54 is a moisture separator 58 which may be a chevron moisture separator. The steam that is produced near tube bundle 40 rises through sleeves 54 where centrifugal swirl vanes 56 cause some of the moisture in the steam to be removed. From sleeves 54, the steam continues to rise through moisture separator 58 where more moisture is removed therefrom. Eventually, the steam rises through steam nozzle 20 from where it is conducted through usual machinery to produce electricity all in a manner well known in the art.

Referring now to the lower portion of FIG. 1, due to the curvature of tubes 38, a straight line section of tube sheet 34 is without tubes therein. This straight line section is referred to as tube lane 60. In conjunction with tube lane 60, two handholes 62 (only one shown) are provided diametrically opposite each other and in colinear alignment with the tube lane 60. Handholes 62 allow limited access to the tube sheet 34 area.

Experience has shown that during steam generator operation sludge may form on tube sheet 34 around tubes 38. This sludge which usually comprises iron oxides, copper compounds, and other metals is formed from these materials settling out of the feedwater onto tube sheet 34. The sludge produces defects in the tubes 38 which allow radioactive particles in the reactor coolant contained in tubes 38 to leak out into the feedwater and steam of the steam generator, a highly undesirable result.

Figure 2:
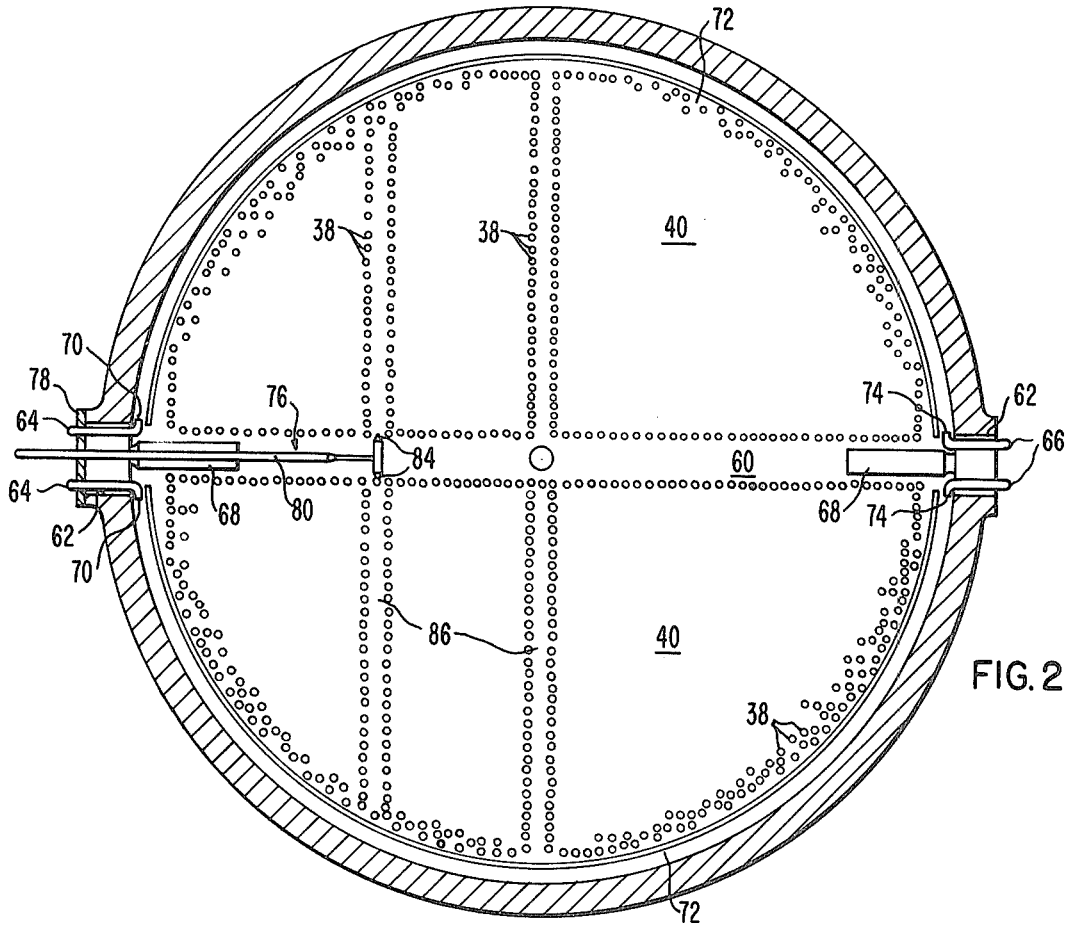
FIG. 2 is a plan view of the tube sheet.
Figure 3:
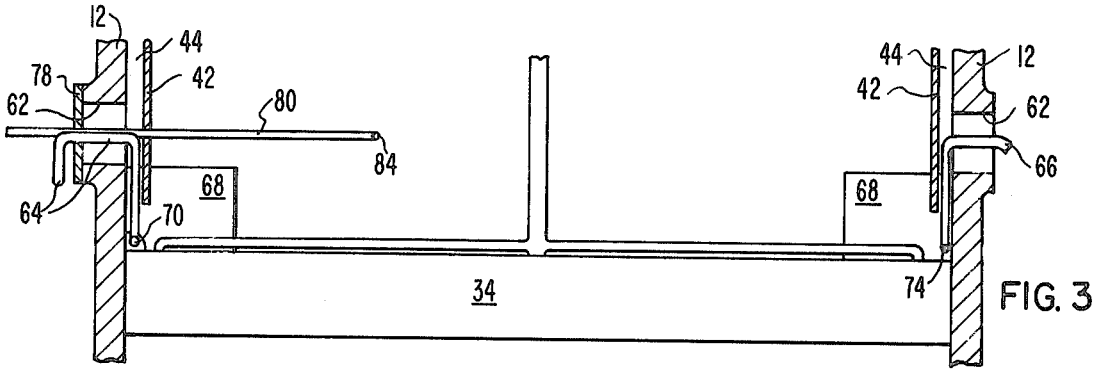
FIG. 3 is a cross-sectional view in elevation of a typical steam generator near the tube sheet.

Referring now to FIG. 2, when the reactor is not operating such as during refueling, the steam generator may be deactivated and drained of the feedwater. Both handholes 62 are then opened to provide access to the interior of the steam generator. An injection header 64 is placed through one of the handholes 62 while a suction header 66 is placed through the other handhole 62. The injection header 64 and the suction header 66 are shaped to fit through the handholes 62 while being able to fit around obstructions such as the tube lane blocking device 68 which may be present near the handholes 62. The injection header 64 is formed so that the two outlets 70 come to rest near the level of sludge accumulation on tube sheet 34. In addition, the outlets 70 which may be 9/16 inch nozzles face opposite each other in the direction of peripheral lane 72 which is formed around the tube bundle 40. Likewise, the inlets 74 of suction header 66 face opposite each other while facing peripheral lane 72. Injection header 64 is connected to a fluid supply such as a water supply and suction header 66 is connected to a suction pump (not shown) such as an air diaphragm suction pump.

Figure 4:
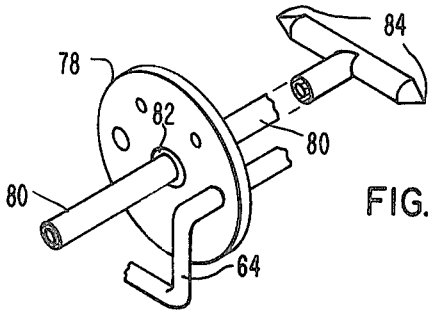
FIG. 4 is a diagram of a typical fluid lance.

Next, a latch 76 such as a high pressure water lance which may be chosen from those well known in the art is bolted to the area surrounding one of the handholes 62 while extending into tube lane 60. The typical lance 76 as shown in FIG. 4 comprises a mounting mechanism 78 which is capable of being bolted to the area surrounding handhole 62, a tubular shaft 80 extending through sealing mechanism 82 of mounting mechanism 78, and at least one nozzle jet 84 disposed on tubular shaft 80. Once lance 76 is in place, the water supply to injection header 64 is activated while the suction pump associated with suction header 66 is activated. The flow of water from outlets 70 which may be approximately 15 to 20 gpm per nozzle causes a peripheral stream of water to be established from outlets 70, through peripheral lane 72 into inlets 74 of suction header 66.

Lance 76 is then activated. Tubular shaft 80 conducts water from a water supply to nozzle jets 84 where nozzle jets 84 direct two high velocity streams therefrom at right angles to tubular shaft 80. Then, either manually or mechanically, tubular shaft 80 is advanced toward the center of the tube bundle 40 through tube lane 60 while tubular shaft 80 is oscillated causing nozzle jets 84 to oscillate in a plane parallel to tubes 38. As lance 76 is advanced nozzle jets 84 become aligned with tube row lanes 86 formed by the spaces between rows of tubes 38. While aligned with each tube row 86, the lance 76 is oscillated in place for approximately one minute. The jets of water emitted from nozzle jets 84 contact the sludge that has accumulated around tubes 38 causing the sludge to be suspended in the water jets. The water jets being a high water flow rate such as about 30 gpm carry the suspended sluge to peripheral lane 72 where the water-sludge mixture becomes entrained in the peripheral stream of water. The peripheral stream then carries the suspended sludge to suction header 66 where the water-sludge mixture is removed from the steam generator.

The lance 76 continues to be advanced until it reaches the center of the tube sheet 34 or a short distance past the center. Lance 76 is then unbolted and removed from the first handhole 62 and inserted through and bolted around the other handhole 62. Once in place in the second handhole, preferably the suction header side, the lance 76 before being activated is quickly advanced to the center of the tube bundle 40. However, in steam generators where there are no obstructions in tube lane 60, lance 76 may be advanced slightly beyond the center of tube bundle 40. Advancing lance 76 slightly beyond the center assures a complete sweep of tube sheet 34 while preventing recirculation of sludge from the second half to the first half of the tube sheet 34. Lance 76 is then activated while tubular shaft 80 is slowly drawn backward causing nozzle jets 84 to move toward the suction header 66. When nozzle jets 84 reach suction header 66 the process is completed. The lance 76, suction header 66, and injection header 64 may be removed and the steam generator reactivated. The system, therefore, provides a method for removing the sludge from between and around heat transfer tubes in a tube sheet of a steam generator by utilizing a water flow system.

While there is described what is now considered to be the preferred embodimet of the invention, it is, of course, understood that various other modifications and variations will occur to those skilled in the art. The claims, therefore, are intended to include all such modifications and variations which fall within the true spirit and scope of the present invention. For example, a lance that performs a similar function but different structurally from that described herein may be used. In addition, a plurality of lances using various flows disposed at various locations around the periphery of the tube sheet may be used in conjunction with the lance as described above. Furthermore, the procedure of traversing the tube sheet may vary according to the particular geometry of the tube sheet in question.

We claim:

1. A method for removing sludge deposits from a steam generator used in an electrical power generation system comprising the steps of:
   - inserting fluid injection appartus into said steam generator near the base thereof;
   - placing fluid suction appartus in said steam generator in a position substantially opposite said fluid injection apparatus;
   - positioning a movable fluid lance in said steam generator near said base;
   - supplying fluid to said fluid injection apparatus and establishing a fluid stream from said fluid injection appartus to said fluid suction apparatus;
   - supplying fluid to said fluid lance and simultaneously discharging the same along said base dislodging said sludge deposits while forming a sludge-fluid mixture that becomes entrained in said fluid stream;
   - moving said fluid lance in a linear direction along said base; and
   - discharging said mixture into said fluid suction apparatus.

2. The method according to claim 1 including the step of discharging said fluid from said fluid lance at an angle to said linear movement and against said base and the heat exchange tubes in said steam generator.

3. The method according to claim 2 including the step of connecting a fluid suction pump to said fluid suction apparatus.

4. The method according to claim 3 including the step of discharging said fluid from said fluid lance at right angles to said linear movement.

5. The method according to claim 4 including the step of establishing said fluid stream along the circumference of said base.

* * * * *